US007963413B2

(12) United States Patent
Sierra-Gomez et al.

(10) Patent No.: US 7,963,413 B2
(45) Date of Patent: Jun. 21, 2011

(54) TAMPER EVIDENT RESEALABLE CLOSURE

(75) Inventors: Gladys O Sierra-Gomez, Woodbridge, NJ (US); Douglas Philipsen, Great Meadows, NJ (US); Carole Cole, Budd Lake, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 903 days.

(21) Appl. No.: 11/438,705

(22) Filed: May 23, 2006

(65) Prior Publication Data

US 2007/0275133 A1 Nov. 29, 2007

(51) Int. Cl.
*B65D 51/18* (2006.01)

(52) U.S. Cl. ..... 220/256.1; 229/87.05; 383/5; 383/203; 383/204; 428/40.1

(58) Field of Classification Search ..... 220/256.1; 229/87.05; 383/5, 203, 204; 428/40.1
See application file for complete search history.

(56) References Cited

U.S. PATENT DOCUMENTS

| | | | |
|---|---|---|---|
| 811,092 | A | 1/1906 | Roberts |
| 1,065,012 | A | 6/1913 | Watanabe |
| 1,106,721 | A | 8/1914 | Lewis |
| 1,171,462 | A | 2/1916 | Rice |
| 1,791,352 | A | 2/1931 | Colonnese |
| 1,963,639 | A | 6/1934 | Ahlquist |
| 1,978,035 | A | 10/1934 | Thom |
| 2,066,495 | A | 1/1937 | Swift |
| 2,128,196 | A | 8/1938 | Vogel |
| 2,475,236 | A | 7/1949 | Gollob |
| 2,554,160 | A | 5/1951 | Von Gunten |
| 2,684,807 | A | 7/1954 | Gerrish |
| 2,965,224 | A | 12/1960 | Harwood |
| 3,080,238 | A | 3/1963 | Kraft et al. |
| 3,127,273 | A | 3/1964 | Monoham |
| 3,179,326 | A | 4/1965 | Underwood et al. |
| 3,186,628 | A | 6/1965 | Rohde |

(Continued)

FOREIGN PATENT DOCUMENTS

AU 768679 6/2001

(Continued)

OTHER PUBLICATIONS

Reclosure system lengthens food life, Packaging News PPMA Preview, Sep. 2001, p. 40.

(Continued)

*Primary Examiner* — Anthony Stashick
*Assistant Examiner* — Elizabeth Volz
(74) *Attorney, Agent, or Firm* — Fitch, Even, Tabin & Flannery

(57) ABSTRACT

A container for a food product including a tamper-evident closure which forms an opening of a container. The closure comprises a sealing layer, adhesively sealed to the top of the container around the opening. The sealing layer is releasable from the container by pulling back on the sealing layer and resealable against the top layer to seal the opening when the sealing layer is moved back against the top. The tamper-evident feature comprises a portion of the top adjacent the opening and covered by the sealing layer, which extends from a position spaced from, and extends towards and terminates at the opening of the container. A portion of the tamper-evident feature falls into the container after the sealing layer has been pulled back for a first time to thereby indicate that the container has been previously opened.

8 Claims, 7 Drawing Sheets

U.S. PATENT DOCUMENTS

| | | | |
|---|---|---|---|
| 3,235,165 | A | 2/1966 | Jackson |
| 3,260,358 | A | 7/1966 | Gottily et al. |
| 3,272,422 | A | 9/1966 | Miller |
| 3,311,032 | A | 3/1967 | Lucas |
| 3,331,501 | A | 7/1967 | Stewart, Jr. |
| 3,343,541 | A | 9/1967 | Bellamy, Jr. |
| 3,373,926 | A | 3/1968 | Voigtman, Sr. et al. |
| 3,454,210 | A | 7/1969 | Spiegel et al. |
| 3,528,825 | A | 9/1970 | Doughty |
| 3,595,468 | A | 7/1971 | Repko |
| 3,618,751 | A | 11/1971 | Rich |
| 3,651,615 | A | 3/1972 | Bohner et al. |
| 3,687,352 | A | 8/1972 | Kalajian |
| 3,740,238 | A | 6/1973 | Graham |
| 3,885,727 | A | 5/1975 | Gilley |
| 3,905,646 | A | 9/1975 | Brackmann et al. |
| 3,910,410 | A | 10/1975 | Shaw |
| 3,938,659 | A | 2/1976 | Wardwell |
| 3,966,046 | A | 6/1976 | Deutschlander |
| 4,156,493 | A | 5/1979 | Julius |
| 4,185,754 | A | 1/1980 | Julius |
| 4,192,420 | A | 3/1980 | Worrell, Sr. et al. |
| 4,192,448 | A | 3/1980 | Porth |
| 4,197,949 | A | 4/1980 | Carlsson |
| 4,258,876 | A | 3/1981 | Ljungerantz |
| 4,260,061 | A | 4/1981 | Jacobs |
| 4,273,815 | A | 6/1981 | Gifford et al. |
| 4,306,367 | A | 12/1981 | Otto |
| 4,364,478 | A | 12/1982 | Tuns |
| 4,397,415 | A | 8/1983 | Lisiecki |
| 4,411,365 | A | 10/1983 | Horikawa et al. |
| 4,420,080 | A | 12/1983 | Nakamura |
| 4,464,154 | A | 8/1984 | Ljungcrantz |
| 4,488,647 | A | 12/1984 | Davis |
| 4,518,087 | A | 5/1985 | Goglio |
| 4,538,396 | A | 9/1985 | Nakamura |
| 4,548,824 | A | 10/1985 | Mitchell et al. |
| 4,548,852 | A | 10/1985 | Mitchell |
| 4,549,063 | A | 10/1985 | Ang et al. |
| 4,550,831 | A | 11/1985 | Whitford |
| 4,552,269 | A | 11/1985 | Chang |
| 4,557,505 | A | 12/1985 | Schaefer et al. |
| 4,570,820 | A | 2/1986 | Murphy |
| 4,572,377 | A | 2/1986 | Beckett |
| 4,608,288 | A | 8/1986 | Spindler |
| 4,610,357 | A | 9/1986 | Nakamura |
| 4,616,470 | A | 10/1986 | Nakamura |
| 4,625,495 | A | 12/1986 | Holovach |
| 4,638,911 | A | 1/1987 | Prohaska |
| 4,648,509 | A | 3/1987 | Alves |
| 4,651,874 | A | 3/1987 | Nakamura |
| 4,653,250 | A | 3/1987 | Nakamura |
| 4,667,453 | A | 5/1987 | Goglio |
| 4,671,453 | A | 6/1987 | Cassidy |
| 4,673,085 | A | 6/1987 | Badouard et al. |
| 4,679,693 | A | 7/1987 | Forman |
| 4,694,960 | A | 9/1987 | Phipps et al. |
| 4,696,404 | A | 9/1987 | Corella |
| 4,723,301 | A | 2/1988 | Chang |
| 4,738,365 | A | 4/1988 | Prater |
| 4,739,879 | A | 4/1988 | Nakamura |
| 4,784,885 | A | 11/1988 | Carespodi |
| 4,790,436 | A | 12/1988 | Nakamura |
| 4,798,295 | A | 1/1989 | Rausing |
| 4,798,296 | A | 1/1989 | Lagerstedt et al. |
| 4,799,594 | A | 1/1989 | Blackman |
| 4,811,848 | A | 3/1989 | Jud |
| 4,818,120 | A | 4/1989 | Addiego |
| 4,838,429 | A | 6/1989 | Fabisiewicz et al. |
| 4,840,270 | A | 6/1989 | Caputo et al. |
| 4,845,470 | A | 7/1989 | Boldt et al. |
| 4,848,575 | A | 7/1989 | Nakamura et al. |
| 4,863,064 | A | 9/1989 | Dailey, III |
| 4,865,198 | A | 9/1989 | Butler |
| 4,866,911 | A | 9/1989 | Grindrod et al. |
| 4,874,096 | A | 10/1989 | Tessera-Chiesa |
| 4,876,123 | A | 10/1989 | Rivera et al. |
| 4,902,142 | A | 2/1990 | Lammert et al. |
| 4,917,247 | A | 4/1990 | Jud |
| 4,943,439 | A | 7/1990 | Andreas et al. |
| 4,972,953 | A | 11/1990 | Friedman et al. |
| 4,998,666 | A | 3/1991 | Ewan |
| 5,000,320 | A | 3/1991 | Kuchenbecker |
| 5,005,264 | A | 4/1991 | Breen |
| 5,029,712 | A | 7/1991 | O'Brien |
| 5,046,621 | A | 9/1991 | Bell |
| 5,048,718 | A | 9/1991 | Nakamura |
| 5,060,848 | A | 10/1991 | Ewan |
| 5,065,868 | A | 11/1991 | Cornelissen et al. |
| 5,076,439 | A | 12/1991 | Kuchenbecker |
| 5,077,064 | A | 12/1991 | Hustad et al. |
| 5,078,509 | A | 1/1992 | Center et al. |
| 5,082,702 | A | 1/1992 | Alband |
| 5,096,113 | A | 3/1992 | Focke |
| 5,100,003 | A | 3/1992 | Jud |
| 5,103,980 | A | 4/1992 | Kuchenbecker |
| 5,124,388 | A | 6/1992 | Pruett et al. |
| 5,158,499 | A | 10/1992 | Guckenberger |
| 5,161,350 | A | 11/1992 | Nakamura |
| 5,167,974 | A | 12/1992 | Grindrod et al. |
| 5,174,659 | A | 12/1992 | Laske |
| 5,184,771 | A | 2/1993 | Jud et al. |
| 5,197,618 | A | 3/1993 | Goth |
| 5,222,422 | A | 6/1993 | Benner, Jr. et al. |
| 5,294,470 | A | 3/1994 | Ewan |
| 5,307,988 | A | 5/1994 | Focke et al. |
| 5,333,735 | A | 8/1994 | Focke et al. |
| 5,344,007 | A | 9/1994 | Nakamura et al. |
| 5,352,466 | A | 10/1994 | Delonis |
| 5,366,087 | A | 11/1994 | Bane |
| 5,375,698 | A | 12/1994 | Ewart et al. |
| 5,381,643 | A | 1/1995 | Kazaitis et al. |
| 5,382,190 | A | 1/1995 | Graves |
| 5,388,757 | A | 2/1995 | Lorenzen |
| 5,405,629 | A | 4/1995 | Marnocha et al. |
| 5,407,070 | A | 4/1995 | Bascos et al. |
| 5,409,116 | A | 4/1995 | Aronsen |
| 3,187,982 | A | 6/1995 | Underwood et al. |
| 5,460,838 | A | 10/1995 | Wermund |
| 5,461,845 | A | 10/1995 | Yeager |
| 5,464,092 | A | 11/1995 | Seeley |
| 5,499,757 | A | 3/1996 | Back |
| 5,503,858 | A | 4/1996 | Reskow |
| 5,505,305 | A | 4/1996 | Scholz et al. |
| 5,519,982 | A | 5/1996 | Herber et al. |
| 5,520,939 | A | 5/1996 | Wells |
| 5,524,759 | A | 6/1996 | Herzberg et al. |
| 5,531,325 | A | 7/1996 | Deflander et al. |
| 5,538,129 | A | 7/1996 | Chester et al. |
| 5,582,853 | A | 12/1996 | Marnocha et al. |
| 5,582,887 | A | 12/1996 | Etheredge |
| 5,591,468 | A | 1/1997 | Stockley, III et al. |
| 5,633,058 | A | 5/1997 | Hoffer et al. |
| 5,637,369 | A | 6/1997 | Stewart |
| 5,647,100 | A | 7/1997 | Porchia et al. |
| 5,647,506 | A | 7/1997 | Julius |
| 5,664,677 | A | 9/1997 | O'Connor |
| 5,688,394 | A | 11/1997 | McBride, Jr. et al. |
| 5,702,743 | A | 12/1997 | Wells |
| 5,725,311 | A | 3/1998 | Ponsi et al. |
| D394,605 | S | 5/1998 | Skiba et al. |
| 5,770,283 | A | 6/1998 | Gosselin et al. |
| 5,791,465 | A | 8/1998 | Niki et al. |
| 5,795,604 | A | 8/1998 | Wells et al. |
| 5,833,368 | A | 11/1998 | Kaufman |
| 5,855,435 | A | 1/1999 | Chiesa |
| 5,862,101 | A | 1/1999 | Haas et al. |
| 5,873,483 | A | 2/1999 | Gortz et al. |
| 5,873,607 | A | 2/1999 | Waggoner |
| 5,882,116 | A | 3/1999 | Backus |
| 5,906,278 | A | 5/1999 | Ponsi et al. |
| 5,908,246 | A | 6/1999 | Arimura et al. |
| 5,928,749 | A | 7/1999 | Forman |
| 5,938,013 | A | 8/1999 | Palumbo et al. |
| 5,939,156 | A | 8/1999 | Rossi et al. |
| 5,945,145 | A | 8/1999 | Narsutis et al. |
| 5,956,794 | A | 9/1999 | Skiba et al. |

| | | | |
|---|---|---|---|
| 5,996,797 | A | 12/1999 | Flaig |
| 5,997,177 | A | 12/1999 | Kaufman |
| 6,026,953 | A | 2/2000 | Nakamura et al. |
| 6,029,809 | A | 2/2000 | Skiba et al. |
| 6,056,141 | A | 5/2000 | Navarini et al. |
| 6,060,095 | A | 5/2000 | Scrimager |
| 6,065,591 | A | 5/2000 | Dill et al. |
| 6,066,437 | A | 5/2000 | Kosslinger |
| 6,077,551 | A | 6/2000 | Scrimager |
| 6,113,271 | A | 9/2000 | Scott et al. |
| 6,125,614 | A | 10/2000 | Jones et al. |
| 6,126,009 | A | 10/2000 | Shiffler et al. |
| 6,126,317 | A | 10/2000 | Anderson et al. |
| 6,152,601 | A | 11/2000 | Johnson |
| 6,164,441 | A | 12/2000 | Guy et al. |
| 6,213,645 | B1 | 4/2001 | Beer |
| D447,054 | S | 8/2001 | Hill |
| 6,273,610 | B1 | 8/2001 | Koyama et al. |
| 6,296,884 | B1 | 10/2001 | Okerlund |
| 6,299,355 | B1 | 10/2001 | Schneck |
| 6,309,105 | B1 | 10/2001 | Palumbo |
| 6,318,894 | B1 | 11/2001 | Derenthal |
| 6,364,113 | B1 | 4/2002 | Faasse, Jr. et al. |
| 6,365,255 | B1 | 4/2002 | Kittel et al. |
| 6,383,592 | B1 | 5/2002 | Lowry et al. |
| 6,420,006 | B1 | 7/2002 | Scott |
| 6,428,867 | B1 | 8/2002 | Scott et al. |
| 6,450,685 | B1 | 9/2002 | Scott |
| 6,457,585 | B1 | 10/2002 | Huffer et al. |
| 6,461,043 | B1 | 10/2002 | Healy et al. |
| 6,461,708 | B1 | 10/2002 | Dronzek |
| 6,471,817 | B1 | 10/2002 | Emmert |
| 6,482,867 | B1 | 11/2002 | Kimura et al. |
| 6,517,243 | B2 | 2/2003 | Huffer et al. |
| 6,539,691 | B2 | 4/2003 | Beer |
| 6,554,134 | B1 | 4/2003 | Guibert |
| 6,589,622 | B1 | 7/2003 | Scott |
| 6,592,260 | B1 | 7/2003 | Randall et al. |
| 6,594,872 | B2 | 7/2003 | Cisek |
| 6,691,886 | B1 | 2/2004 | Berndt et al. |
| 6,698,928 | B2 | 3/2004 | Miller |
| 6,726,054 | B2 | 4/2004 | Fagen et al. |
| 6,726,364 | B2 | 4/2004 | Perell et al. |
| 6,746,743 | B2 | 6/2004 | Knoerzer et al. |
| 6,767,604 | B2 | 7/2004 | Muir, Jr. et al. |
| 6,865,860 | B2 | 3/2005 | Arakawa |
| 6,889,483 | B2 | 5/2005 | Compton et al. |
| 6,918,532 | B2 | 7/2005 | Sierra-Gomez et al. |
| 6,929,400 | B2 | 8/2005 | Razeti et al. |
| 6,951,999 | B2 | 10/2005 | Monforton et al. |
| 6,983,875 | B2 | 1/2006 | Emmott |
| 7,007,423 | B2 | 3/2006 | Andersson et al. |
| 7,021,827 | B2 | 4/2006 | Compton et al. |
| 7,032,757 | B2 | 4/2006 | Richards et al. |
| 7,040,810 | B2 | 5/2006 | Steele |
| 7,165,888 | B2 | 1/2007 | Rodick |
| 7,172,779 | B2 | 2/2007 | Castellanos et al. |
| 7,213,710 | B2 | 5/2007 | Cotert |
| 7,228,968 | B1 | 6/2007 | Burgess |
| 7,261,468 | B2 | 8/2007 | Schneider et al. |
| 7,262,335 | B2 | 8/2007 | Motsch et al. |
| 7,302,783 | B2 | 12/2007 | Cotert |
| 7,344,744 | B2 | 3/2008 | Sierra-Gomez et al. |
| 7,350,688 | B2 | 4/2008 | Sierra-Gomez et al. |
| 7,371,008 | B2 | 5/2008 | Bonenfant |
| 7,422,142 | B2 | 9/2008 | Arippol |
| 7,475,781 | B2 | 1/2009 | Kobayashi |
| 7,516,599 | B2 | 4/2009 | Doll et al. |
| 7,533,733 | B2 | 5/2009 | Nolan |
| 7,533,773 | B2 | 5/2009 | Aldridge et al. |
| 7,600,641 | B2 | 10/2009 | Burgess |
| 7,717,620 | B2 | 5/2010 | Hebert et al. |
| 2001/0000480 | A1 | 4/2001 | Stagg et al. |
| 2003/0019780 | A1 | 1/2003 | Parodi et al. |
| 2003/0039412 | A1 | 2/2003 | Rodick |
| 2003/0118255 | A1 | 6/2003 | Miller |
| 2003/0183637 | A1 | 10/2003 | Zappa et al. |
| 2003/0183643 | A1 | 10/2003 | Fagen et al. |
| 2003/0210838 | A1 | 11/2003 | Steele |
| 2003/0223656 | A1 | 12/2003 | Razeti et al. |
| 2004/0011677 | A1 | 1/2004 | Arakawa et al. |
| 2004/0062838 | A1 | 4/2004 | Castellanos et al. |
| 2004/0067326 | A1 | 4/2004 | Knoerzer et al. |
| 2004/0083680 | A1 | 5/2004 | Compton et al. |
| 2004/0091184 | A1 | 5/2004 | Miller |
| 2004/0112010 | A1 | 6/2004 | Richards et al. |
| 2004/0150221 | A1 | 8/2004 | Brown |
| 2004/0175060 | A1 | 9/2004 | Woodham et al. |
| 2004/0180118 | A1 | 9/2004 | Renger et al. |
| 2004/0206637 | A1 | 10/2004 | Sierra-Gomez et al. |
| 2005/0000965 | A1 | 1/2005 | Boardman |
| 2005/0084188 | A1 | 4/2005 | Caris |
| 2005/0117819 | A1 | 6/2005 | Kingsford et al. |
| 2005/0220371 | A1 | 10/2005 | Machacek |
| 2005/0247764 | A1 | 11/2005 | Sierra-Gomez et al. |
| 2005/0276525 | A1 | 12/2005 | Hebert et al. |
| 2006/0018569 | A1* | 1/2006 | Bonenfant ..... 383/5 |
| 2006/0066096 | A1 | 3/2006 | Kan |
| 2006/0083446 | A1 | 4/2006 | Sampaio Camacho |
| 2006/0124494 | A1 | 6/2006 | Clark, Jr. et al. |
| 2006/0147129 | A1 | 7/2006 | Miller |
| 2006/0171611 | A1 | 8/2006 | Rapparini |
| 2006/0251342 | A1 | 11/2006 | Forman |
| 2006/0257599 | A1 | 11/2006 | Exner et al. |
| 2006/0285779 | A1 | 12/2006 | Golas |
| 2007/0023436 | A1 | 2/2007 | Sierra-Gomez et al. |
| 2007/0095709 | A1 | 5/2007 | Saito et al. |
| 2007/0140600 | A1 | 6/2007 | Nowak et al. |
| 2007/0209959 | A1 | 9/2007 | Burgess |
| 2007/0275133 | A1 | 11/2007 | Sierra-Gomez et al. |
| 2008/0013869 | A1 | 1/2008 | Forman |
| 2008/0037911 | A1 | 2/2008 | Cole et al. |
| 2008/0060751 | A1 | 3/2008 | Arrindell |
| 2008/0063759 | A1 | 3/2008 | Raymond et al. |
| 2008/0063760 | A1 | 3/2008 | Raymond et al. |
| 2008/0135428 | A1 | 6/2008 | Tallier |
| 2008/0152264 | A1 | 6/2008 | Pokusa et al. |
| 2008/0156861 | A1 | 7/2008 | Sierra-Gomez et al. |
| 2008/0214376 | A1 | 9/2008 | Bonenfant |
| 2008/0240627 | A1 | 10/2008 | Cole et al. |
| 2009/0022431 | A1 | 1/2009 | Conner |
| 2009/0028472 | A1 | 1/2009 | Andersson et al. |
| 2009/0053372 | A1 | 2/2009 | Hambrick et al. |
| 2009/0190866 | A1 | 7/2009 | Hughes |
| 2009/0226117 | A1 | 9/2009 | Davis et al. |
| 2009/0273179 | A1 | 11/2009 | Scott et al. |
| 2010/0002963 | A1 | 1/2010 | Holbert et al. |
| 2010/0018974 | A1 | 1/2010 | Lyzenga et al. |
| 2010/0019022 | A1 | 1/2010 | Ryan et al. |
| 2010/0111453 | A1 | 5/2010 | Dierl |
| 2010/0113241 | A1 | 5/2010 | Hebert et al. |

FOREIGN PATENT DOCUMENTS

| | | |
|---|---|---|
| AU | 2002334419 | 5/2003 |
| AU | 2004295316 | 6/2005 |
| AU | 2005254459 | 12/2005 |
| AU | 2008223524 | 3/2007 |
| AU | 2006337982 | 8/2007 |
| AU | 2007309154 | 5/2008 |
| AU | 2008229190 | 9/2008 |
| DE | 9014065 | 4/1991 |
| DE | 4134567 | 1/1993 |
| EP | 0388310 | 9/1990 |
| EP | 0 474 981 | 3/1992 |
| EP | 0474981 | 3/1992 |
| EP | 0488967 | 6/1992 |
| EP | 0546369 | 6/1993 |
| EP | 0447636 | 3/1994 |
| EP | 0613824 | 3/1994 |
| EP | 0613824 | 9/1994 |
| EP | 0629561 | 12/1994 |
| EP | 0661154 | 7/1995 |
| EP | 0667828 | 8/1995 |
| EP | 0752375 | 1/1997 |
| EP | 0796208 | 9/1997 |
| EP | 0758993 | 3/1998 |
| EP | 0905048 | 3/1999 |
| EP | 0744357 | 10/2000 |

| | | |
|---|---|---|
| EP | 1056066 | 11/2000 |
| EP | 1 375 380 | 1/2004 |
| EP | 1375380 | 1/2004 |
| EP | 1382543 | 1/2004 |
| EP | 1437311 | 7/2004 |
| EP | 1449789 | 8/2004 |
| EP | 1457424 | 9/2004 |
| EP | 1468936 | 10/2004 |
| EP | 1477425 | 11/2004 |
| EP | 1086906 | 5/2005 |
| EP | 1609737 | 12/2005 |
| EP | 1609737 | 1/2006 |
| EP | 1619137 | 1/2006 |
| EP | 1637472 | 3/2006 |
| EP | 1697230 | 9/2006 |
| EP | 1755980 | 2/2007 |
| EP | 1770025 | 4/2007 |
| EP | 1608567 | 7/2007 |
| EP | 1858776 | 10/2008 |
| EP | 1712488 | 12/2008 |
| EP | 1846306 | 3/2009 |
| EP | 2033910 | 3/2009 |
| FR | 1 327 914 | 4/1963 |
| FR | 2674509 | 10/1992 |
| FR | 2766794 | 2/1999 |
| GB | 2276095 | 9/1994 |
| JP | 60080405 | 5/1985 |
| JP | 9150872 | 6/1997 |
| JP | 09156677 | 6/1997 |
| JP | 1059441 | 3/1998 |
| JP | 10129685 | 5/1998 |
| JP | 11198977 | 7/1999 |
| JP | 2000335542 | 12/2000 |
| JP | 200662712 | 3/2006 |
| WO | 9532902 | 12/1995 |
| WO | 9725200 | 7/1997 |
| WO | 02/066341 | 8/2002 |
| WO | 03/013976 | 2/2003 |
| WO | 03/059776 | 7/2003 |
| WO | 2008074060 | 6/2008 |
| WO | 2008122961 | 10/2008 |
| WO | 2009065120 | 5/2009 |
| WO | 2009111153 | 9/2009 |
| WO | 2010002834 | 1/2010 |
| WO | 2010080810 | 1/2010 |

OTHER PUBLICATIONS

Patent Abstracts of Japan, vol. 1997 No. 10, Oct. 31, 1997 & JP09156677 A (Fuji Seal Col Ltd.), (Jul. 6, 1997) abstract in English and 7 figures.

"Elite Edam Cheese", Mintel gnpd, Dec. 3, 2001, Mintel Publishing.

"New Easy Peel Cheese Packaging", Mintel gnpd, Aug. 10, 2001, Mintel Publishing.

"Cheese Range", Mintel gnpd, Jan. 26, 2001, Mintel Publishing.

"Soft Bread Sticks", Mintel gnpd, Mar. 20, 1998, Mintel Publishing.

"New on the Shelf—Product Instructions and Packaging Trends", Circle Reader Service Card No. 93, Aug. 1998, Baking & Snack. Machinery Update, Mar./Apr. 2002, pp. 59-60.

*Reseal-it*. [Homepage of Macfarlane Group] [Online] 2005. Available at http//www.reseal-it.se [accessed Mar. 14, 2005].

Giant Baby Wipes package, item No. 80203-91, resealable package having die cut-out portions (tabs) which remain affixed to the top of the package after label is withdrawn from the top, whereby tamper evidence is indicated by a misalignment of the die cut-out portions with the holes formed in the label.

Reseal-It. Web page Internet print out. (accessed Mar. 14, 2005).

* cited by examiner

TAMPER EVIDENT RESEALABLE CLOSURE

FIELD OF THE INVENTION

The present invention relates generally to packages for storing articles and, more particularly, to a tamper-evident, resealable closure for such packages.

BACKGROUND OF THE INVENTION

Some containers for food products, such as cookies and other snacks, typically include a frame surrounded by an outer wrapper. The frame acts as a tray to hold the food product and to protect the food product from damage. One normally gains access to the contents of the container by opening one end of the wrapper, withdrawing the tray from inside thereof, and removing the food product from the tray. Reclosing the wrapper, once opened, generally includes folding or rolling the end down and clipping the end to keep the wrapper closed.

One recent advancement in the art of food containers includes a resealable container disclosed in U.S. Pat. No. 6,918,532 (hereinafter the "'532 patent"), herein incorporated by reference. The '532 patent discloses a wrapper which forms a top of the container which has an access opening. A sealing layer is adhesively sealed to the top around the opening. The sealing layer is releasable from the container by pulling back on a tab and the sealing layer is resealable against the top layer to seal the opening when the sealing layer is moved back to a flat position on the top.

Other food products come packaged in plastic trays, such as thermoform trays which are sealed on the top using some type of lidding material. Several conventional lidding materials are available for covering conventional trays. Lidding materials may be metal foil, flexible plastic wrap or rigid plastic. One recent advancement in lidding materials for covering thermoform trays is provided in U.S. patent application Ser. No. 11/193,613 (herein incorporated by reference), which incorporates a resealable opening with a sealing layer similar to the one in the '532 patent.

In the packaging art, different methods have been used to indicate whether a package has been previously opened or whether the integrity of the package has been compromised. For example, in one prior dispensing bag for moistened tissues, shown in U.S. Pat. No. 6,428,867, tamper evidence is provided by a sealing label with an ink layer in the sealing area which leaves ink indicia in the sealing area to indicate that the package has been previously opened.

In another container, shown in U.S. patent application Ser. No. 11/029,651, herein incorporated by reference, various additional methods are shown to indicate whether a sealing layer has previously been removed from the container. One disclosed means for tamper-evident indication is the use of die-cut elongated strips running adjacent to the opening in the sealing area which is defined as the area around the opening of the container, under the sealing layer. One limitation with the use of the prior elongated strips is that the wrapper adjacent the elongated strips may become torn as the sealing layer is pulled back, thus compromising the integrity of the container's top.

There is a need in the art for a resealable container, preferably suitable for containing food items, which includes a new and improved tamper-evident indicator.

BRIEF SUMMARY OF THE INVENTION

The present invention generally relates to a resealable closure having a tamper-evident feature in the form of a flap or elongated strip which terminates at an opening covered by the closure which falls into the container after the container has been opened for the first time.

The present invention, in one form, comprises a tamper-evident resealable closure comprising a first film layer, and a first tear line and a second tear line formed in the first film layer. The first tear line defines a first panel section for providing an access opening through the film layer when separated from the first film layer along the first tear line. The second tear line runs from a position spaced from the first tear line to a position terminating at the first tear line and defining a second panel section for indicating an initial opening of the closure when the second panel is separated from the first film layer along the second tear line. A second film layer is disposed on the first film layer and covers the first and second panel sections. The second film layer includes an adhesive layer for resealably adhering a second film layer such that the first panel section is separated from the second film layer to expose the access opening and the second panel section is separated from the first and second film layers to provide a visual indication the closure has been opened after the second film layer has been removed from a first film layer.

In another form of the present invention, a tamper-evident closure comprises a wrapper forming a top of a container where the top has an access opening into the container. A sealing layer is adhesively sealed to the top around the opening. The sealing layer is releasable from the top by pulling the sealing layer back in a peeling direction and reclosable against the top to seal the opening when the sealing layer is moved back against the top. A slit in the wrapper is located in the sealing area between the access opening and an adjacent edge of the container where the sealing layer is adhesively sealed to the top. The slit has a first end spaced from the opening and a second end terminating at the opening wherein the slit extends, in the peeling direction, from being spaced away from the opening to the opening.

In one further embodiment of the present invention, the slit forms an elongated strip. In an alternative further embodiment, the wrapper comprises a second slit adjacent to the first slit, extending from a position spaced from the opening and terminating at the opening, to form an elongated strip having one end spaced from the opening and a second end terminating at the opening.

The present invention, in another form thereof, concerns a tamper-evident food container comprising a wrapper forming a container having a top where the top has an access opening so as to provide hand access to food contents of the container. A sealing layer is provided which is adhesively sealed to the top around the opening. The sealing layer is releasable when the sealing layer is pulled back in a peeling direction and reclosable against the top to seal the opening when the sealing layer is moved back against the top. A slit is provided in the wrapper located in a sealing area between the access opening and the adjacent edge of the container where the sealing layer is adhesively sealed to the top. The slit has a first end spaced from the opening and a second end terminating at the opening wherein the slit extends in the peeling direction from being spaced away from the opening and terminating at the opening.

Other features and advantages of the present invention are stated in or apparent from detailed descriptions of presently preferred embodiments of the invention found hereinbelow.

DETAILED DESCRIPTION OF THE INVENTION

Figure 1:
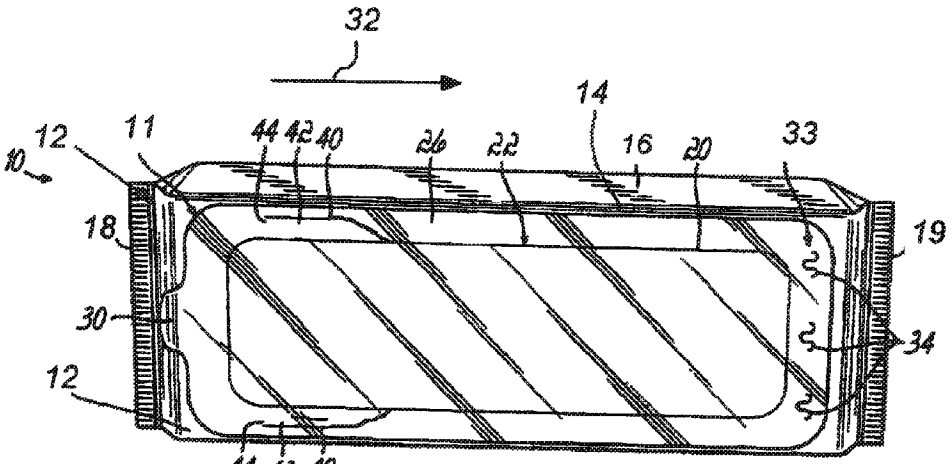
FIG. 1 is a perspective view of a package including an exemplary closure according to the present invention.

Referring now to the Figures, and in particular FIGS. 1-9, there is shown package 10 with closure 11 which incorporates a tamper-evident feature. Package 10 includes an outer wrapper which forms a first layer 12 of top 14, side 16 and crimped ends 18, 19. The first film layer 12 is formed from polymeric film or other flexible material that has been cut, folded or otherwise processed to define an interior space or receptacle for receiving the desired product, such as food items to be provided within a package 10. Package 10 can be used to store and distribute foodstuff, such as cookies, crackers, candy or other items. The film layer 12 may include graphics or other indicia to identify the contents of the package 10.

The closure 11 is formed directly on the first film layer 12 and includes a first tear line 20 formed into the first film layer 12. The first tear line 20 defines a first panel 22 that may be separate from the first film layer 12 along the tear line 20 to expose an opening 24 (FIG. 4) whereby access to the contents of the package 10 may be gained. Although the first tear line 20 is in the form of a full or complete rectilinear form, alternatively, tear line 20 may only include three sides, whereby first panel 22 is permanently attached to the first film layer 12 on one end and, thus, not cut on that one end.

Closure 11 further includes at least one second tear line 40 as a slit formed in the first film layer 12 adjacent to the first tear line 20. The second tear line 40 produces a second panel section 42 formed by the second tear line 40, which remains integrally joined to the first film layer 12 along end 44 of the panel 42 proximate the tab 30 end of the package 10. The second tear line 40 has a generally crescent shape extending from a position spaced from the opening 24 defined by the first tear line 20, all the way to the first die cut 20. As a result, as viewed in the peeling direction 32, the second die cut 40 extends from a position spaced away from the first die cut 20 to the die cut 20.

The closure 11 includes a second film layer in the form of a sealing label such as sealing layer 26 disposed on the top 14 of the package 10 on the first film layer 12. The sealing layer 26 extends beyond the periphery of the first tear line 20 along a sealing area adjacent to the opening 24 to thereby cover the first panel section 22 and second panel 42.

This side of the second film layer 26, which faces the first film layer 12, is coated with an adhesive 28 (see FIGS. 3-5) so that the second film layer 26 may be releasably secured to the first film layer 12. The sealing layer 26 is provided with a tab 30 or other gripping feature which is not coated with adhesive 28 so that the sealing layer 26 may be peeled back from the first film layer 12 to open the package 10.

Figure 2A:
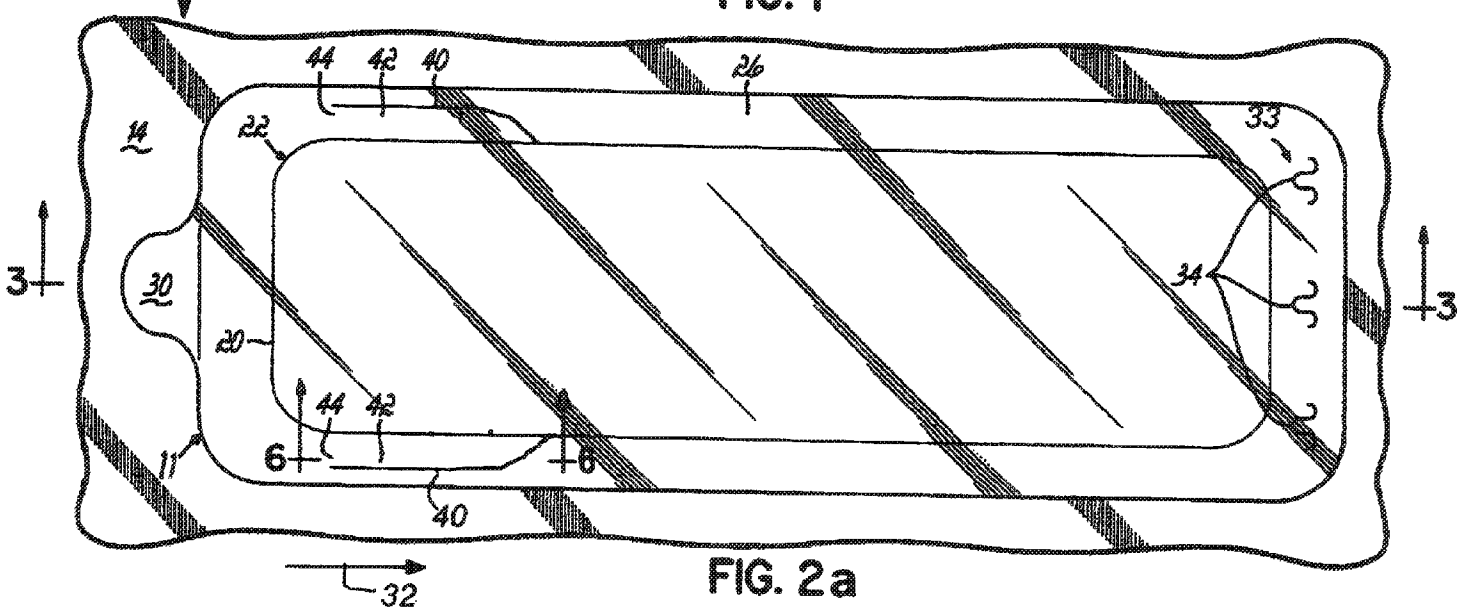
FIG. 2*a* is an enlarged plan view of the closure depicted in FIG. 1, showing the package prior to being opened for a first time.
Figure 2B:
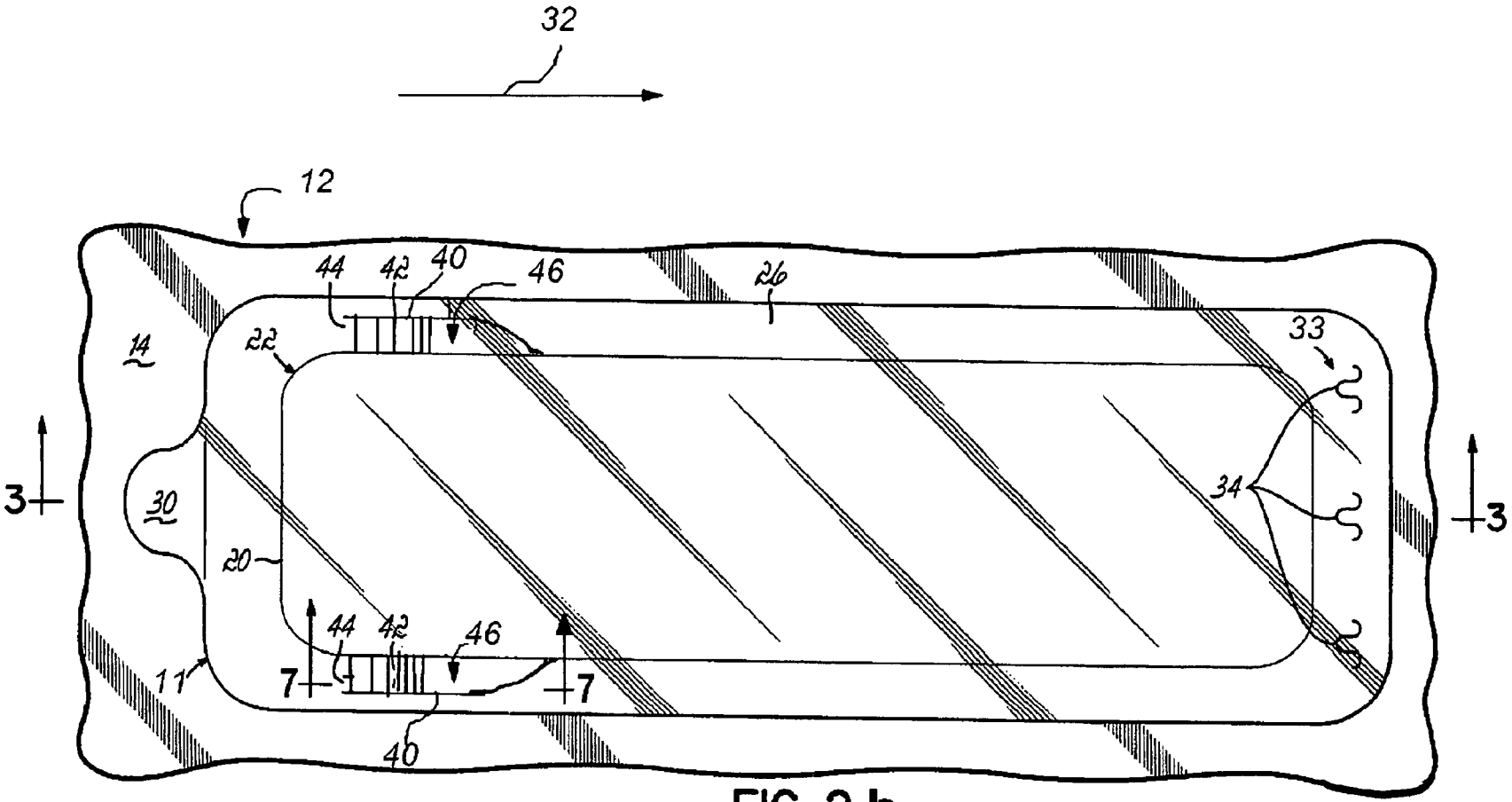
FIG. 2*b* is the same closure of FIG. 2*a*, shown after the package has been opened and subsequently resealed in accordance with the present invention.

The sealing layer 26 may include a hinge portion 33, depicted in FIGS. 1, 2*a* and 2*b* as a series of undulating die cuts 34 formed through the sealing layer 26 along a peripheral edge positioned opposite the tab 30. As the sealing layer 26 is peeled back, the undulating die cuts 34 help to keep the edge of the sealing layer 26 adhesively secured to first film layer 12, while permitting the sealing layer 26 to be moved away from the access opening 24 to facilitate access to the contents of the package 10. While the hinge portion has been shown and described herein as comprising a series of undulating die cuts 34, it will be recognized that the hinge portion 33 may comprise a fold line defining a hinge or other arrangement suitable for hingedly coupling the sealing layer 26 to the first film layer 12.

Figure 3:
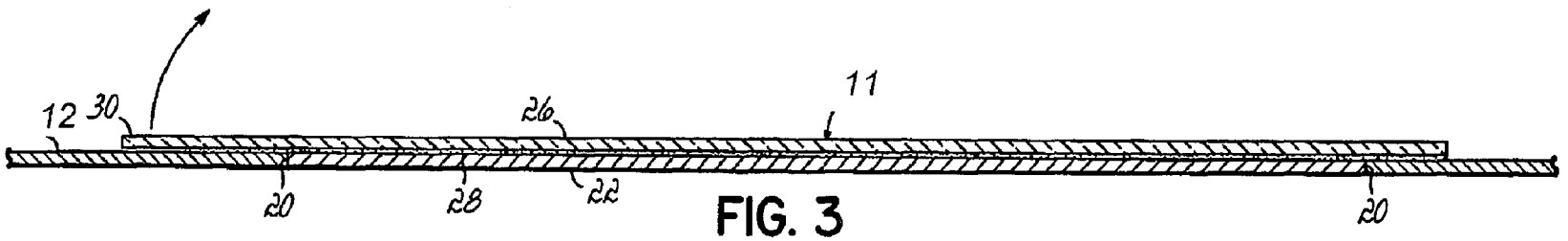
FIG. 3 is a cross-sectional view of the closure of FIG. 2*a*, taken along line 3-3.
Figure 4:
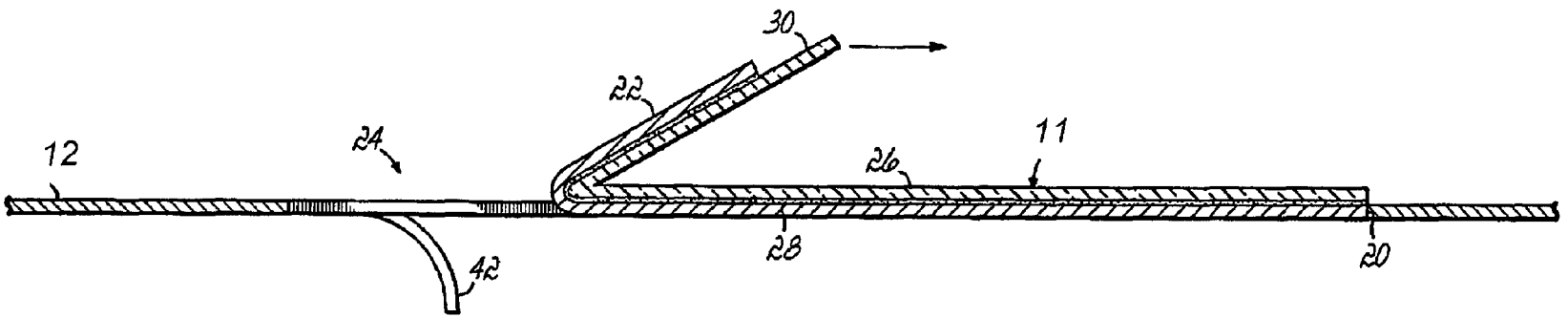
FIG. 4 is a cross-sectional view of the closure of FIG. 3, depicting an initial opening of the closure.
Figure 5:
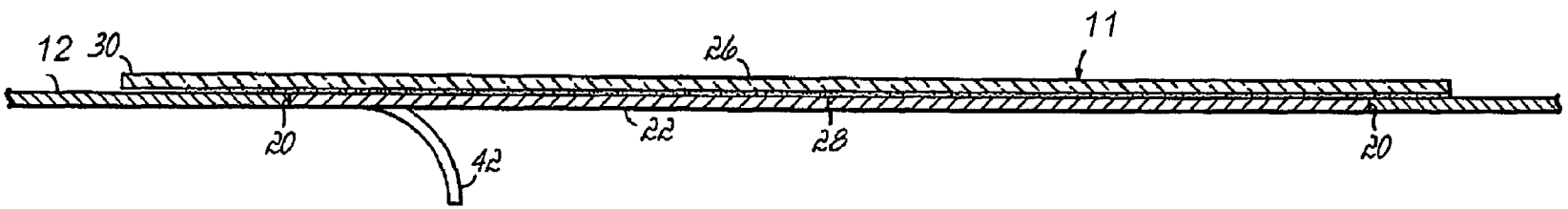
FIG. 5 is a cross-sectional view of the closure of FIG. 3, depicting a resealed configuration of the closure after the initial opening.

As shown in FIGS. 3 and 4, the first panel section 22 is separated from the first film layer 12 along the first tear line 20 and remains adhered to the sealing layer 26 as the sealing layer 26 is peeled back in a peeling direction indicated by arrow 32 (FIGS. 1, 2 and 4) to open the package 10. After the contents of the package 10 have been accessed and it is desired to reseal the package 10, the sealing layer 26 may be reapplied to the first film layer 12, approximately in its original position, as depicted in FIG. 5. Because the sealing layer 26 extends beyond the periphery of the first panel section 22, the adhesive 26 disposed thereon facilitates resealing the package 10 with the first panel section 22 positioned over the access opening 24.

When the sealing layer 26 is peeled away from the first layer 12 to separate the first panel section 22 for a first time, a portion of the second panel section 42 is separated from the first film layer 12, but the integrally joined portion 44 of the second panel 42 ensures that the second panel 42 does not become completely separated from the first film layer 12. The second panel 42, therefore, remains attached to the first film layer 12 and eventually becomes separated from the adhesive coated second film layer 26 as the second film layer 26 is peeled back for a first time in direction 32. Referring to the schematic of FIG. 9, as the sealing layer 26 is pulled back for a first time, the first tear line 20 tears successively, as indicated by the series of arrows 52, and the second tear line 40 tears successively as indicated by arrows 50 until the second tear line 40 terminates at the first tear line 20.

An advantage of having the second die cut extend and terminate at a first die cut is that any residual adhesive force which is applied to the respective second portions will be directed to the first die cut and, thus, the opening of the container, and not extend along the first layer to tear and/or potentially jeopardize the integrity of the package.

Figure 7:
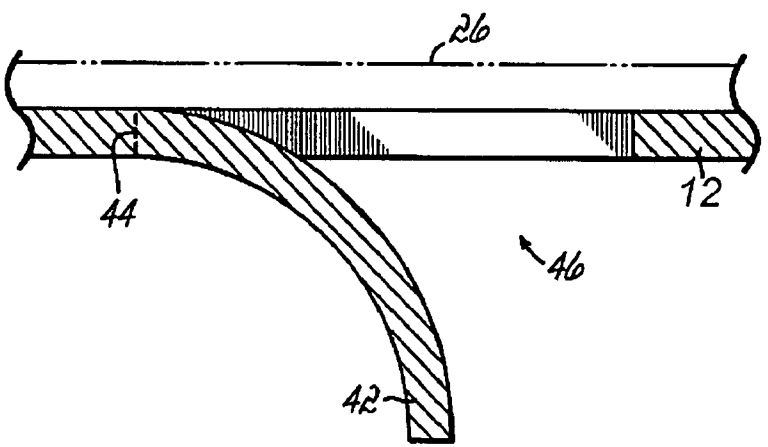
FIG. 7 is a cross-sectional view of the closure of FIG. 2*b*, taken along line 7-7.
Figure 6:
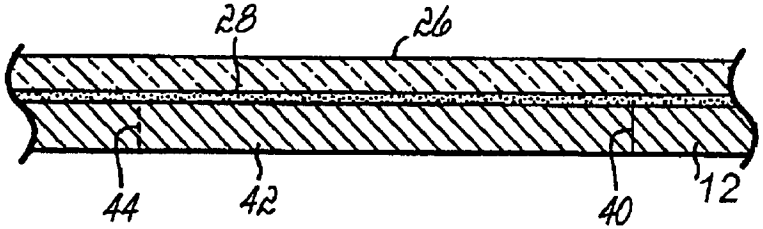
FIG. 6 is an enlarged cross-sectional view of the closure of FIG. 2*a*, taken along line 6-6.
Figure 8:
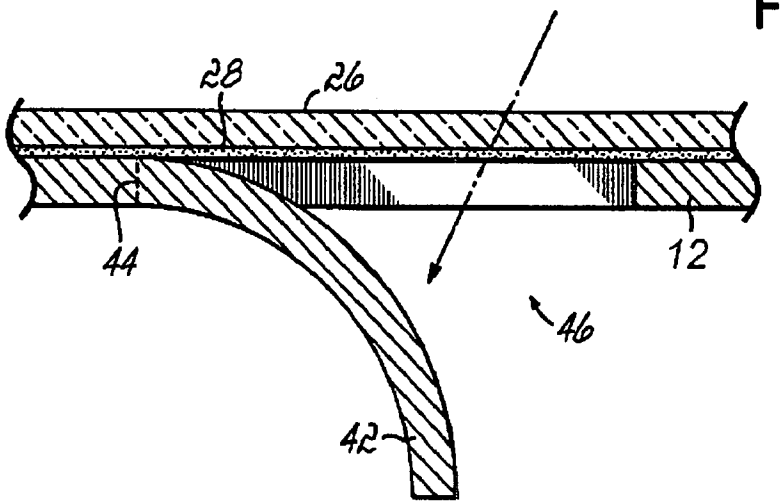
FIG. 8 is a cross-sectional view of the closure of FIGS. 6 and 7, depicting a resealed condition of the closure.

The material of the first layer 12 is formed such that the second panel section 42 moves in a direction away from the top 14 and inward of the package 10 when it becomes separated from the first film layer 12 and the sealing layer 26, as depicted in FIGS. 2*b*, 4 and 7. Thereafter, the second panel section 42 provides a visual indication of an initial opening of the package 10 even when the sealing layer 26 is resealed against the first film layer 12 to reclose the package 10. Specifically, the second panel section 42 remains joined to the first film layer 12 at end 44 while the remainder of the second panel 42 extends downwardly into the package 10, as depicted in FIGS. 2*b*, 4, 5, 7 and 8, to create a void area 46 that is visually detectable when viewing the package 10.

While FIGS. 1-8 show and describe an outer wrapper which forms a first layer 12 that covers the entire exterior of a package, the first layer 12 may form only a top surface of a package having a resealable opening, such as those packages disclosed in U.S. patent application Ser. No. 11/193,613, and thus closure 11 can form a closure over a thermoform tray having a first sealing layer as a lidding material over the top of the tray.

The first film layer 12 may be formed from polypropylene, polyethylene, cellophane, or any other polymeric material suitable for forming a package enclosure. Likewise, the sealing layer 26 may be formed from polypropylene, polyethylene or any other polymeric material suitable for forming a selectively releasable and resealable cover that can be adhered to the first film layer 12 as described above.

Figure 9:
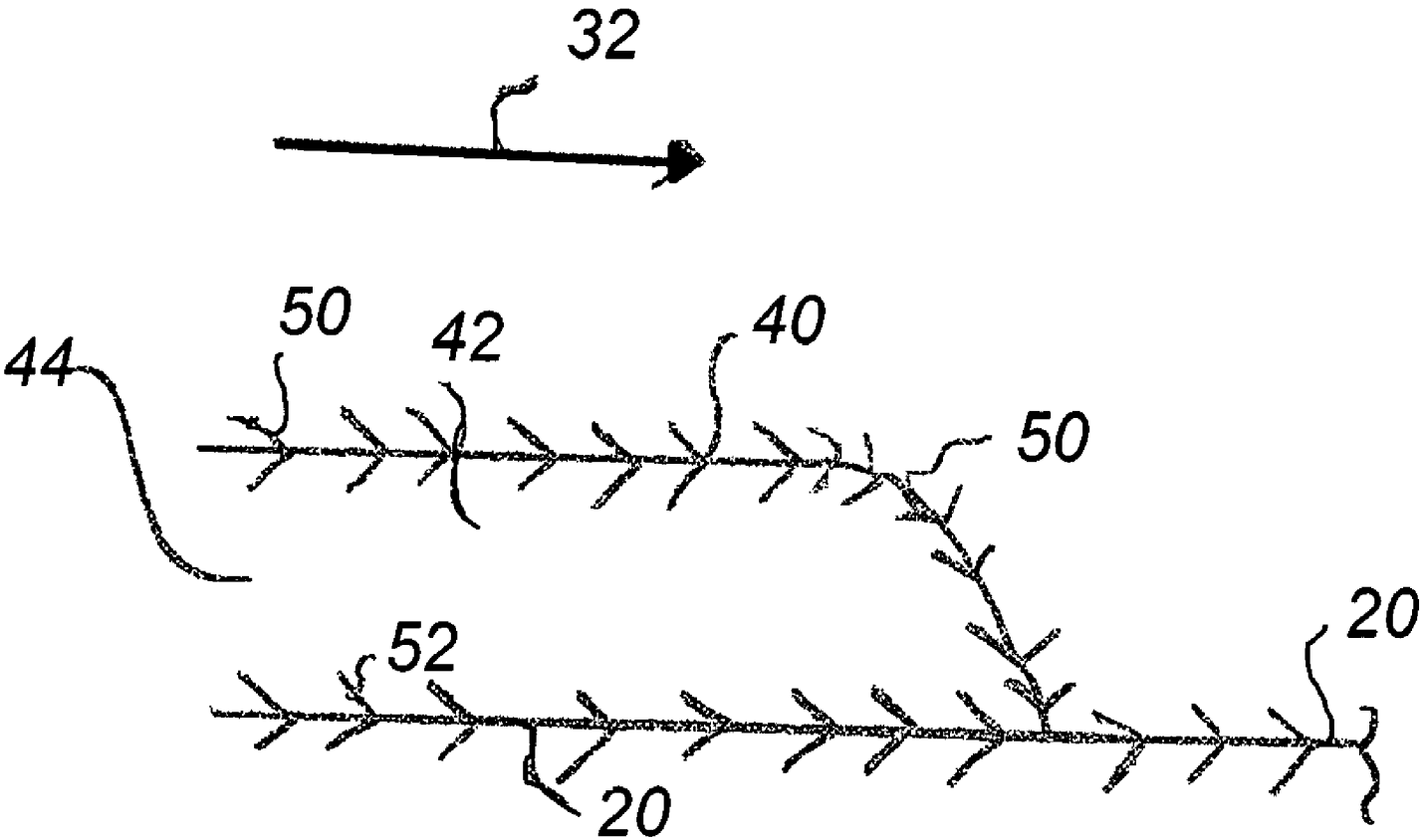
FIG. 9 is a schematic showing the separation of the tamper-evident feature from the package of FIG. 1, in accordance with the present invention.
Figure 10A:
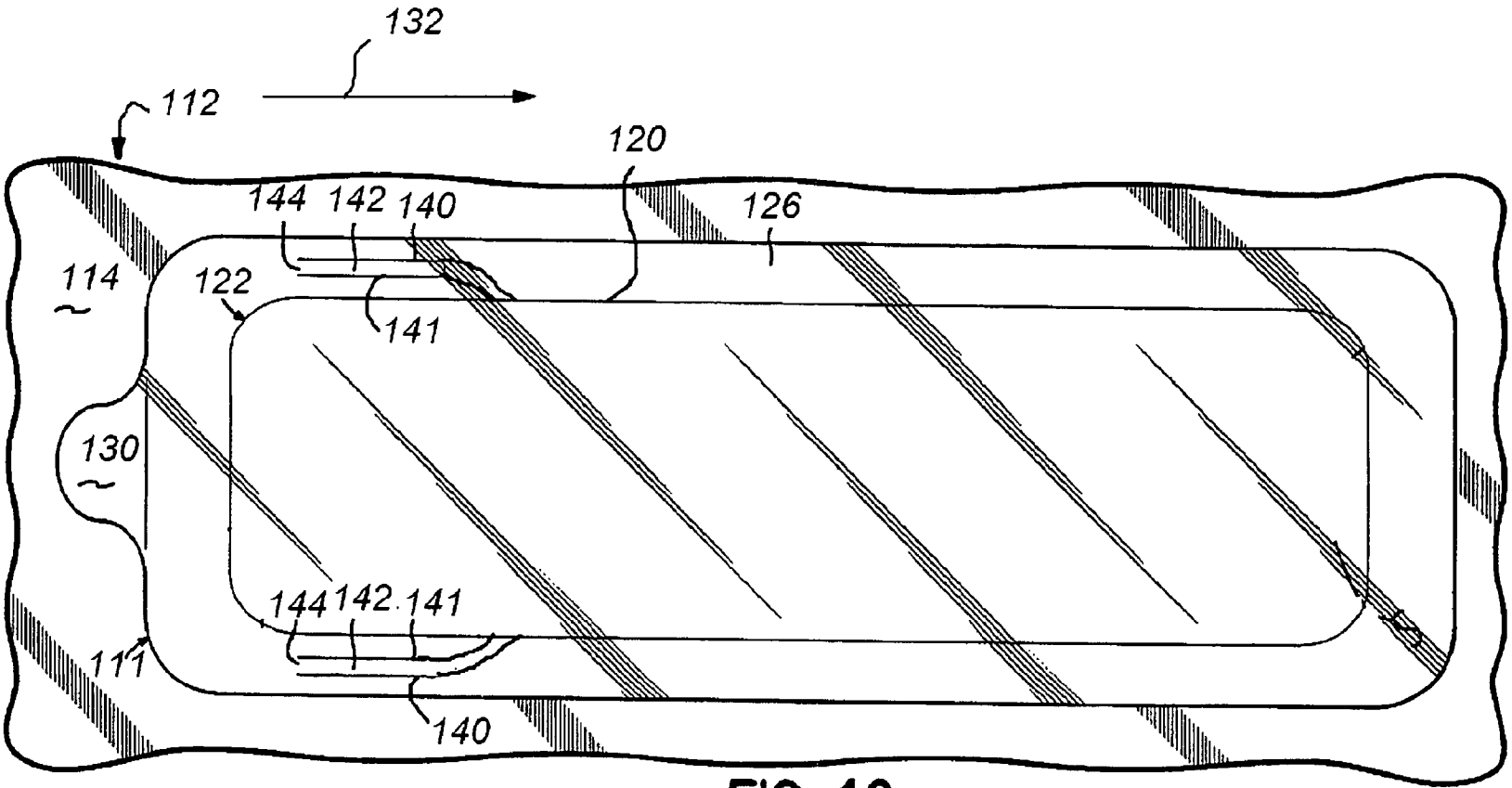
FIG. 10*a* is a plan view of a package including another closure, according to another aspect of the present invention, shown prior to opening the closure for a first time.
Figure 10B:
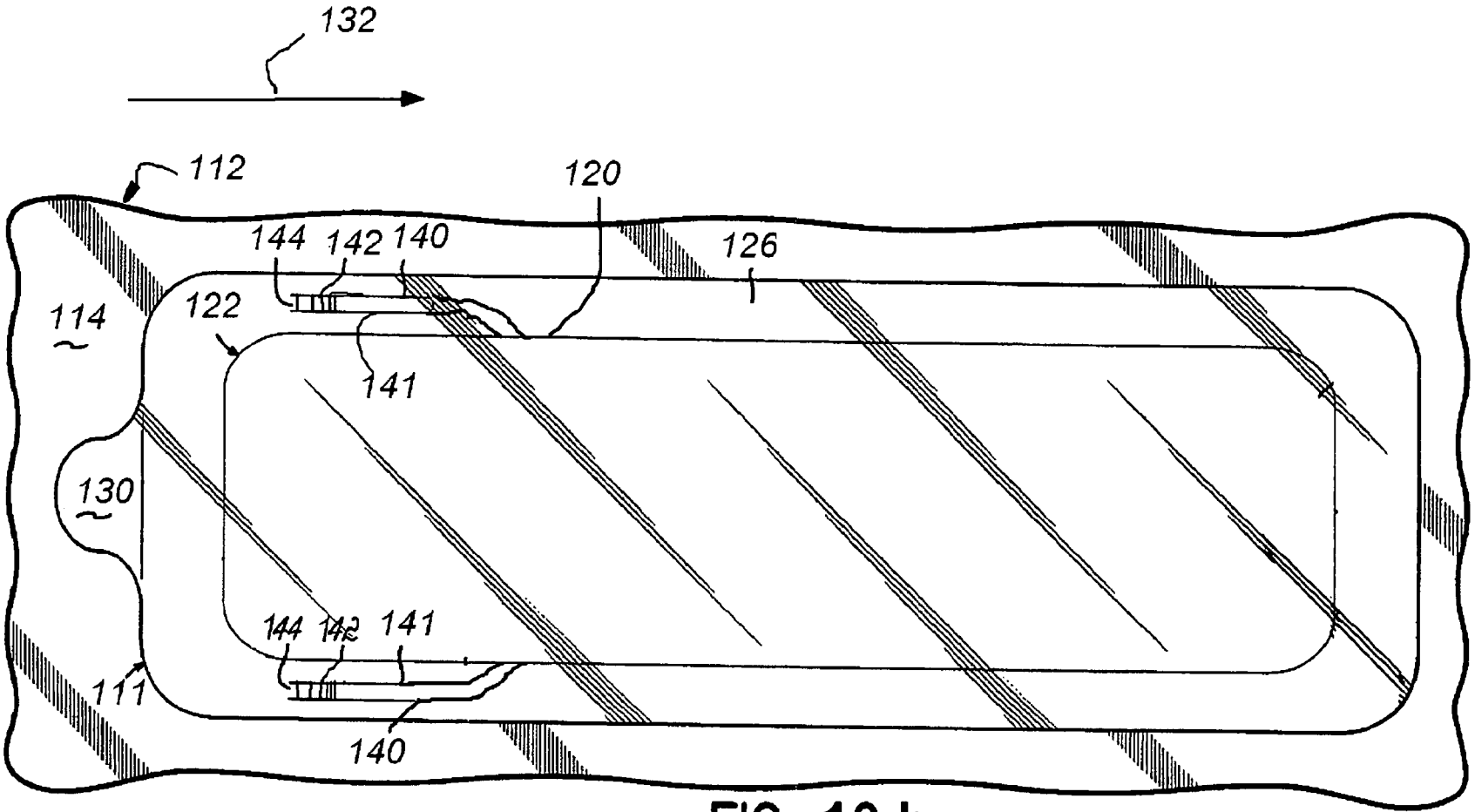
FIG. 10*b* is the same closure depicted in FIG. 10*a*, shown after the closure has been previously opened and resealed.

Referring now to FIGS. 10*a* and 10*b*, package 110 includes a closure 111 similar to that of package 10. Package 110 differs from package 10 in that a third die cut 141 is formed in first sealing layer 112 which is parallel to second die cut 140 to thereby define a second panel 142 which is in the form of a generally elongated strip extending from a portion 144 spaced away from the first die cut 120 proximate the tab 130 and extending to the first die cut 120 as viewed in the peeling direction 132. As with package 10, one gains access into package 110 by pulling back on tab 130 which releases sealing layer 126 from the first layer 112 sealed to top 114, which separates the first panel 122 from the first layer 112, thereby exposing the opening (not shown). In addition, as the sealing layer 126 is pulled back in direction 132, the second panel 142 is separated from the first outer layer 114 on all sides except for the portion 144 which is permanently attached to the first outer layer 112. As in the embodiment of FIGS. 1-9, as shown in FIGS. 10*a* and 10*b*, the outer slit tears along a line that turns in and terminates at line 120. In this embodiment, the inner slit 141 also turn in and terminates at line 120. As a result, the second portion 142 separates from the adhesive of the sealing layer 126 and top 114, and falls into the package 110, as shown in FIG. 9*b*.

It will now be apparent to one of ordinary skill in the art that the present tamper-evident features of the present closure offers benefits over prior tamper-evident features.

The invention claimed is:

1. A tamper-evident closure for a container comprising:

a wrapper forming a top of the container, said top having a first tear line defining a first panel providing an access opening into the container when the first panel has been separated from a remainder of the wrapper;

a sealing layer, adhesively sealed to said top around said opening, said sealing layer being releasable from said top by pulling the sealing layer back in a peeling direction and reclosable against said top to seal said opening when said sealing layer is moved back against said top; and a second tear line in the wrapper located in a sealing area between the access opening and an adjacent edge of the container where said sealing layer is adhesively sealed to said top, said second tear line having a first end spaced from said opening and a second end terminating at the first tear line defining said opening, the second tear line defining a second panel for indicating an initial opening of the closure when the second panel is separated from said wrapper along said second tear line and such that first and second panels are contiguous prior to initial opening.

2. The tamper-evident closure of claim 1, wherein said slit forms an elongated strip.

3. The tamper-evident closure of claim 1, wherein said wrapper comprises a second slit adjacent said slit extending from a position spaced from said opening and terminating at said opening to form an elongated strip having one end spaced from said opening and a second end terminating at said opening.

4. The tamper-evident closure of claim 3, wherein said elongated strip falls into said container when said sealing layer is peeled back for a first time.

5. A tamper-evident food container comprising:

a wrapper forming a container having a top, said top having a first tear line defining a first panel providing an access opening so as to provide hand access to food contents of the container when the first panel has been separated from a remainder of the wrapper;

a sealing layer, adhesively sealed to said top around said opening, said sealing layer being releasable when said sealing layer is pulled back in a peeling direction and reclosable against said top to seal said opening when said sealing layer is moved back against said top; and a second tear line in the wrapper defining a second panel located in a sealing area between the access opening and the adjacent edge of the container where said sealing layer is adhesively sealed to said top, said second panel providing an indication of initial opening of the food container once the second panel is separated from said wrapper along said second tear line, said second tear line having a first end spaced from said opening and a second end terminating at the first tear line defining said opening, wherein said second tear line extends in said peeling direction and the first and second panels are contiguous prior to initial opening.

6. The container of claim 5, further comprising a food product within the container.

7. The container of claim 6, wherein said wrapper comprises a second slit adjacent said slit to form an elongated strip having one end spaced from said opening and a second end terminating at said opening.

8. The tamper-evident closure of claim 7, wherein said elongated strip falls into said container when said sealing layer is peeled back for a first time.

* * * * *